US005178595A

United States Patent [19]

MacGregor

[11] Patent Number: 5,178,595

[45] Date of Patent: Jan. 12, 1993

[54] WALKING DEVICE TO ASSIST THOSE WITH AN INJURY TO A LOWER LIMB

[76] Inventor: Douglas MacGregor, 972 East 5650 South, Salt Lake City, Utah 84121

[21] Appl. No.: 834,815

[22] Filed: Feb. 13, 1992

[51] Int. Cl.[5] ..... A63B 25/00

[52] U.S. Cl. ..... 482/75; 135/68; 623/28; 602/26

[58] Field of Search ..... 482/75, 76, 66; 135/65, 135/66, 68; 673/28, 29; 602/26

[56] References Cited

U.S. PATENT DOCUMENTS

| | | | |
|---|---|---|---|
| 1,185,906 | 6/1916 | Hoff | 623/28 |
| 2,242,748 | 5/1941 | Fulwiler | 482/75 |
| 2,678,054 | 5/1954 | Bostelman | 135/68 |
| 2,827,897 | 3/1958 | Pawlowski | 623/28 |
| 3,065,962 | 11/1962 | Hoffmeister | 482/75 |
| 4,058,119 | 11/1977 | Rosequist | 623/28 |
| 4,141,375 | 2/1979 | Tykwinski | 135/66 |
| 4,254,948 | 3/1981 | Jacobs | 135/68 |
| 4,291,715 | 9/1981 | Monte | 135/68 |
| 4,924,894 | 5/1990 | Martinez | 135/68 |

*Primary Examiner*—Richard J. Apley
*Assistant Examiner*—Lynne Reichard
*Attorney, Agent, or Firm*—Mallinckrodt & Mallinckrodt

[57] ABSTRACT

Unlike the prior art crutch that in essence extends the shoulder to the ground to bear the weight of the injured person when walking, the novel walking device of the invention includes an upright staff that extends the pelvis to the ground on the side of an injury. Upper and lower receiving members for receiving and securing to the thigh and calf of an injured leg are attached to the staff and securing means secure the thigh and calf to said receiving means. The injured limb bears the load in compression rather than in shear.

19 Claims, 5 Drawing Sheets

WALKING DEVICE TO ASSIST THOSE WITH AN INJURY TO A LOWER LIMB

BACKGROUND OF THE INVENTION

1. Field

The invention is in the field of medical devices to assist walking for those with leg or foot injuries.

2. State of the Art

When injuries occur to the leg or foot, the injured limb is typically put in a cast or splint and the injured person walks with the aid of a cane or crutches, or uses a wheelchair to achieve mobility.

When an injured limb is held in the usual walking cast or splint and the injured person walks with the aid of a cane or crutches, the load on the injured limb is transmitted through the cast to the skin in shear. The load is also transmitted from the skin to the muscles and from the muscles to the skeleton in shear.

Furthermore, the use of a cane or a pair of crutches undesirably requires the use of the user's hands. Holding and operating the cane or the pair of crutches is awkward and burdensome. This makes operating door latches and knobs or carrying items very difficult. Merely operating the crutches can be difficult in tight places where there is not ample room for maneuvering.

The use of a wheelchair to achieve mobility also has its drawbacks. The wheelchair requires the use of the user's hands to push the wheels. Wheelchairs are bulky. Even if the chair is the collapsible type, it is too bulky to easily load into many smaller automobiles. Also, it is more expensive than either a cane or crutches.

In the past, the options for mobilizing those with lower limb injuries has been essentially limited to canes, crutches, or wheelchairs. There has not been provided any specialized means for mobilizing those with leg or foot injuries that do not require the use of the user's hands.

SUMMARY OF THE INVENTION

The walking device of the invention provides an inexpensive, easily transportable, alternative means of mobilizing those with lower limb injuries, especially those with injuries to the knee, ankle, and foot and frees the user's hands. It essentially eliminates weight bearing by the leg, knee, ankle, and foot. Whatever load remains on the injured limb is borne in compression instead of in shear.

Unlike the prior art crutch that in essence extends the shoulder to the ground to help bear the weight of the injured person when walking, the invention includes an upstanding staff that extends the pelvis to the ground on the side of an injury. The wearer essentially sits on the device. Because the device is secured to the thigh and calf of the wearer, the wearer's hands are free to open doors, carry objects, or even use an additional support such as a cane.

The device comprises an upstanding staff, upper and lower receiving members attached to said staff which are adapted to receive the thigh and shin of an injured limb so that the injured limb bears very little load, the weight of the body being transmitted to the ground from the hip socket with the gluteal muscle being only in slight compression, and securing means for securing the upper and lower receiving members to the thigh and shin of the wearer. A foot is provided by placing a rubber tip on the end of the staff, or several alternative feet may be provided.

THE DRAWINGS

What is presently contemplated as the best modes for carrying out the invention commercially are illustrated in the accompanying drawings, in which:

FIG. 1 is a side elevational view of the walking device of the invention attached to the injured leg of a wearer;

FIG. 2, a front elevational view of the device of FIG. 1;

FIG. 3, a fragmentary vertical section of a preferred foot for the device taken along line 3—3 of FIG. 1 and drawn to a larger scale;

FIG. 4, a front elevational view of an alternative foot for the device drawn to a larger scale;

FIG. 5, a front elevational view of another alternative foot for the device drawn to the same scale as FIG. 4;

FIG. 6, a front elevational view of yet another alternative foot for the device drawn to the scale of FIG. 4;

FIG. 7, a side elevational view of still another alternative foot for the device drawn to the scale of FIG. 4;

FIG. 8, a side elevational view of a final alternative foot for the device drawn to the scale of FIG. 4;

FIG. 9, a side elevational view of an alternative embodiment of the walking device of the invention showing just the frame and not the padded receiving members;

FIG. 10, a front elevation view of the alternative embodiment of FIG. 9;

FIG. 11, side elevational view of the complete padded receiving member of the embodiment of FIG. 9 drawn to a slightly larger scale than that of FIG. 9

FIG. 12, a bottom plan view of just the platform portion of the receiving member shown in FIG. 9;

FIG. 13, a side elevational view taken from the right side of just the frame of an alternative embodiment of a walking device according to the invention;

FIG. 14, a front elevational view of the embodiment of FIG. 13 taken along line 14—14 of FIG. 13;

FIG. 15, a side elevational view taken along line 15—15 of FIG. 14 from the left side;

FIG. 16, a side elevational view taken from the right side of the embodiment of FIG. 13, drawn to a slightly larger scale and showing in addition to the frame, a padded receiving member; and FIG. 17, a side elevational view of the device shown in FIG. 16 taken from the left side.

DETAILED DESCRIPTION OF THE ILLUSTRATED EMBODIMENTS

Figure 1:
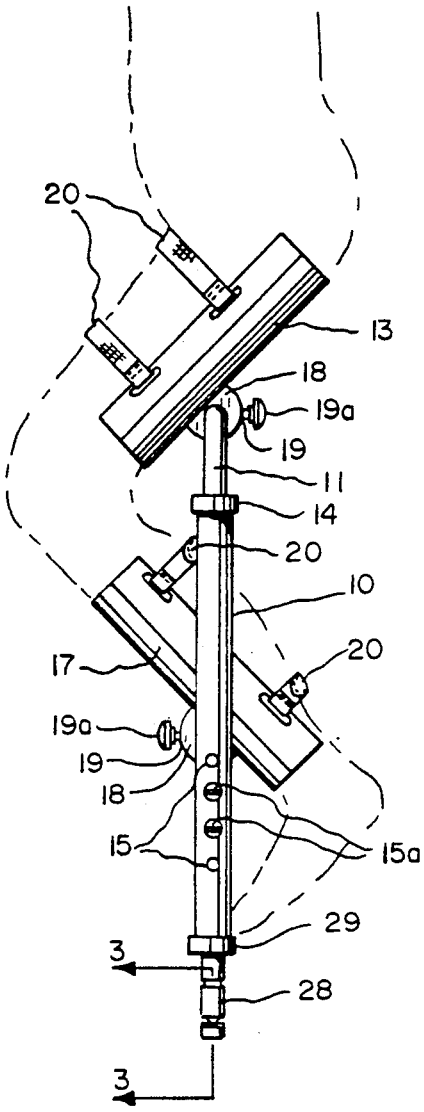

As illustrated, the walking device of FIG. 1 includes an upstanding staff 10. Staff 10 is preferably of hollow, tubular cross-section and constructed of sturdy yet lightweight material, such as aluminum. However, the choice of material is entirely optional. It is also contemplated that the invention could be solid and constructed of wood or other sturdy material.

Figure 2:
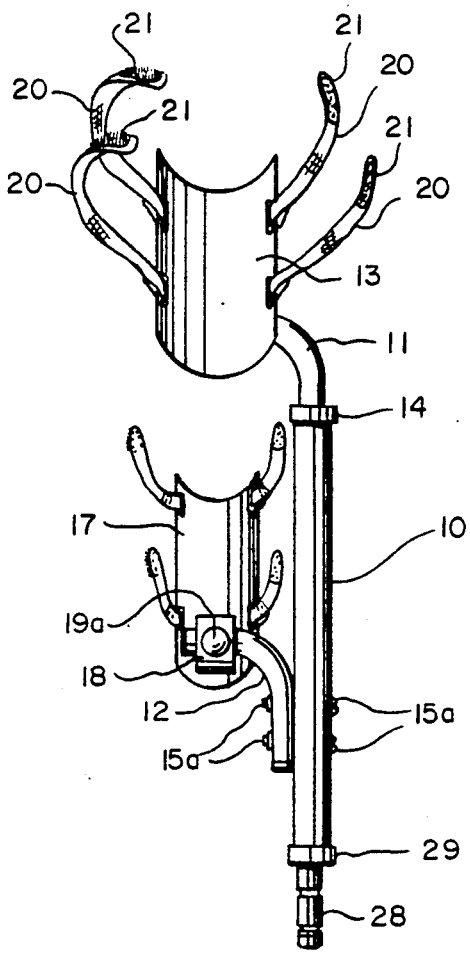

As shown in FIG. 2, staff 10 has attached thereto along its upper and lower portions, upper and lower extension arms 11 and 12. Upper extension arm 11 has attached thereto upper receiving member 13 for receiving the thigh of the injured leg of a wearer. Upper extension arm 11 can be and preferably is slidably received into the upper end of tubular staff 10. In the embodiment depicted, locking collar 14 is provided at the upper end of staff 10. Locking collar 14 can be unlocked to allow the height of upper extension arm 11 to be adjusted so as to make up an overall height for the device suited to the height of a particular wearer. Once the height is adjusted locking collar 14 is then locked to hold extension ar 11 in place.

Alternatively, staff 10 and extension arm 11 are provided with a plurality of holes drilled therethrough for receiving preferably at least two attachment means for securing upper extension arm 11 to staff 10. The plurality of holes are adapted to attach the extension arm at varying heights along the staff so as to accommodate users of different heights and to allow for adjustment to suit the comfort of individual wearers. As shown in FIGS. 1 and 2, staff 10 has holes 15 drilled therethrough as does lower extension arm 12. Holes 15 receive attachment means, here shown as nuts and bolts, 15*a*, for attaching lower extension arm 12 to staff 10.

Figure 10:
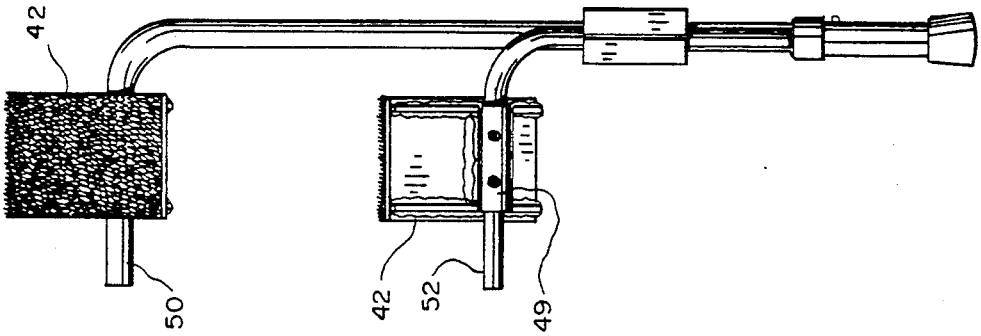
Figure 9:
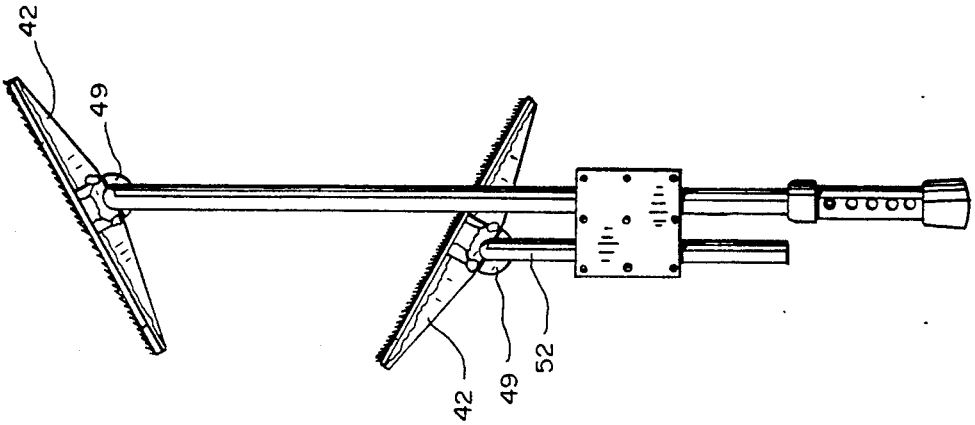

As shown in FIG. 2, upper extension arm 11 can be a separate member adjustably attached to staff 10 so that the height of the extension arm is adjustable. However, an upper extension arm could be formed from the upper portion of the upstanding staff by simply bending the upper portion at or near a right angle, as shown in FIG. 10.

In the form illustrated in FIGS. 1, 2, 9, and 10, the lower receiving member is attached directly to the upstanding staff. However, it is perhaps advantageous that the lower receiving member be suspended from the upper receiving member and so indirectly attached to the staff.

The surfaces of upper receiving member 16 and lower receiving member 17 can be roughened or have holes drilled therethrough so that such receiving members can be securely attached or mounted within the typical plaster cast or other cast material as is usually applied to an injured limb. The receiving members so mounted in the cast are then secured to their respective extension arms. If the upper receiving member is to be embedded in a cast, it may be unnecessary to use a lower receiving member.

In FIGS. 1 and 2, upper receiving member 16 and lower receiving member 17 are provided with clamping means, here shown in the form of an adapter fitting 18 for securing said receiving members to their extension arms. Adapter fitting 18 is provided with a threaded member 19 which has a knob 19*a* which when loosened allows adjustment of the angle at which upper and lower receiving members are held relative to the horizontal plane. Once the angle is adjusted, threaded member 19 is tightened, thus, fixing adapter fitting 18 to the extension arm. Means for adjusting the angle of the receiving members are provided to allow the device to be fitted to suit the comfort of individual wearers. However, it is not necessary that the receiving members be supplied with adapter fitting 18 or that the receiving members be adjustably attached to the extension arms. The receiving members could simply be attached to the extension arms by any attachment means for securing the two parts together. Or, alternatively, the receiving members can be provided with adapter fitting 18 but the two pieces might be secured together by welding or nonadjustable attachment means.

Securing means, here shown in the form of straps 20, for securing the device to the injured limb are provided. Straps 20 are provided with attachment means, here shown if the form of velcro strips 21, for attaching opposite ends of the straps together and around the thigh and calf of the wearer and to, respectively, the upper and lower receiving members. As shown in FIG. 2, a pair of straps, 20, are attached to each receiving member..Alternatively, straps 20 may be provided with other attachment means such as buckles or clasps.

As just described, the inclined upper and lower receiving members receive the calf and thigh of the wearer. When the injured limb is secured to the device, the skin, muscles, and skeleton of the thigh and shin bear the load essentially in compression without a significant load in shear.

Figure 3:
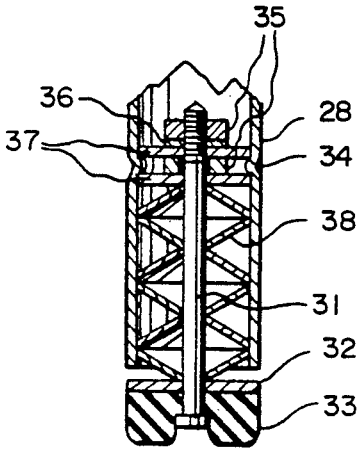

The lowermost end of staff 10 may simply be provided with a rubber tip, or, alternatively, with different foot designs to fill a variety of specialized needs. Shown in FIGS. 1, 2, and 3, is foot 28. Foot 28 contains a spring-loaded mechanism. It fits within the lower end of staff 10 and is secured there by locking collar 29. When locking collar 29 is loosened, the height of foot 28 can be adjusted to suit the height and comfort of an individual wearer. As shown in FIG. 3, foot 28 includes plunger 31. Plunger 31 includes contact member 32 and rubber pad 33. Plunger 31 is secured within foot 28 by the action of indentation 34 against the plunger attachment assembly. Indentation 34 is stamp pressed into foot 28. It secures the plunger attachment assembly which is comprised of nuts 35, small washer 36, and large washers 37. Spring 38 absorbs some of the shock of the user's stride and provides a send off during the rollover of the stride. As shown, plunger 31 is attached within separate foot 28. However, plunger 31 and the plunger attachment assembly could be attached directly within a recess in the bottom of staff 10.

Figure 4:
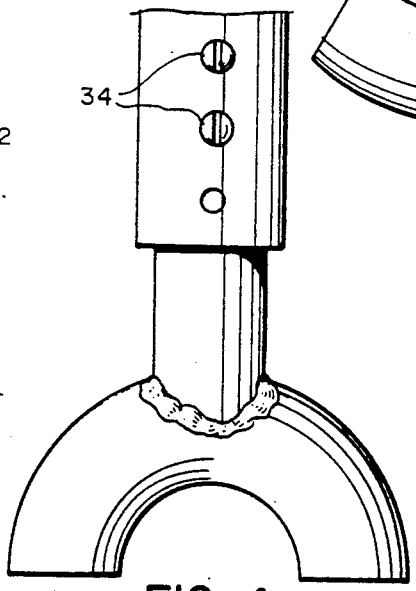
Figure 5:
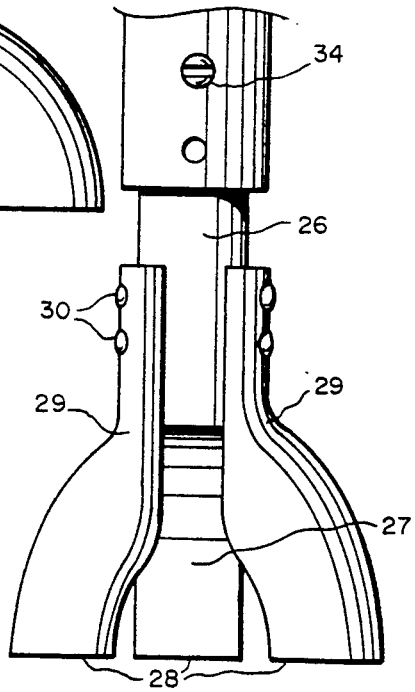

A simple alternative foot, a bipod foot, may be provided as a separate foot piece, as shown in FIG. 4. Another alternative foot is the tripod foot, as shown in FIG. 5. As shown, the main foot member is angled to provide upper section 26 which is received by the lower end of staff 10 and lower section 27 which is angled out, then down to provide a surface, 28, for contact with the ground. Two other foot members, 29, are provided. They are secured by attachment means, 30, along their upper section. The lower end of foot members, 29, provide two additional contact surfaces, 28, for contact with a walking surface.

Figure 7:
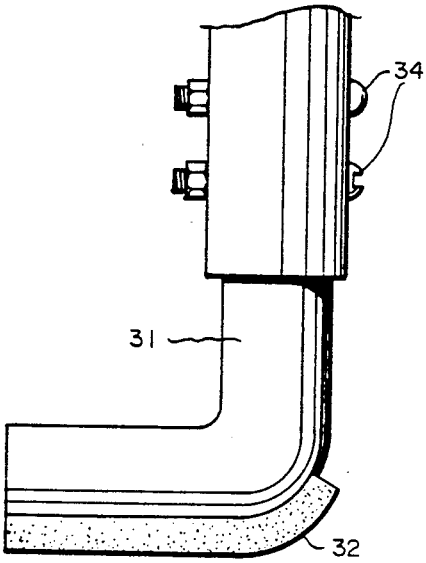
Figure 8:
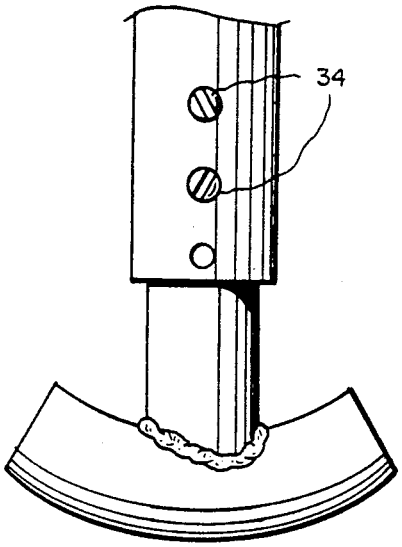
Figure 6:
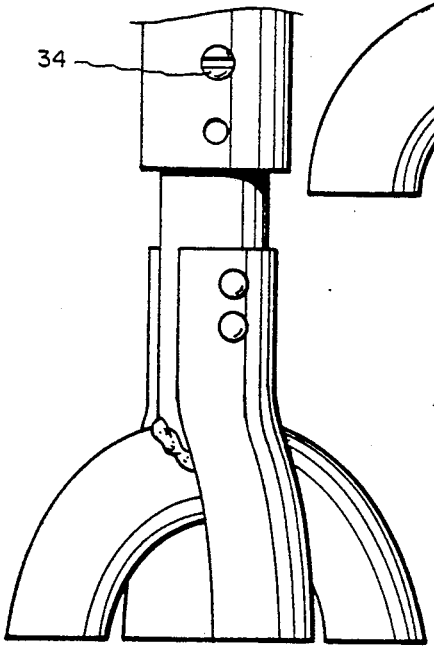

FIG. 6 shows a separate quadripod foot constructed similarly to the feet shown in FIGS. 4 and 5. FIG. 7 shows a right angle foot, 31, with attached rubber pad, 32. FIG. 8 shows a rocker foot.

The feet in FIGS. 4–8 are shown as separate foot pieces attached to the lower end of staff 10 by attachment means, 34, which adjustably attach the feet to staff 10 so that the height of the feet may be adjusted. It is understood, however, that the feet need not be adjustably attached to the staff but may be formed from the lower end of staff 10 and/or include the lower portion of the staff and have attached to such lower portion, the component foot parts to make up the various feet, i.e., a spring-loaded foot, a right angle foot, a bipod foot, a tripod foot, a quadripod foot, and a rocker foot.

Figure 12:
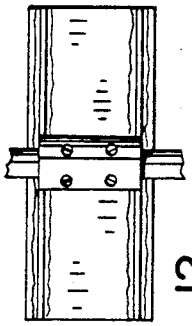
Figure 11:
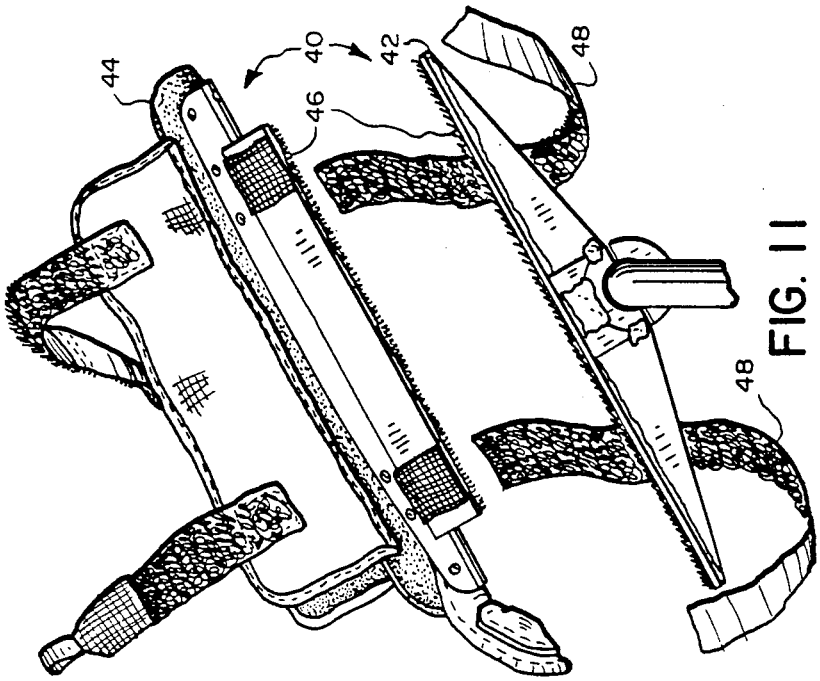

FIGS. 9–12 show an alternative embodiment of the receiving members. As shown in FIG. 11, receiving members 40 are comprised of platforms 42 and pads 44 which are removably and adjustably attached to on another by velcro 46 and securing means, here shown as straps 48. As best shown in FIG. 12, the underneath side of platform 42 is provided with clamp 49. Clamp 49 adjustably secures platform means 42 to either upper extension arm 50 or lower extension arm 52.

Figure 14:
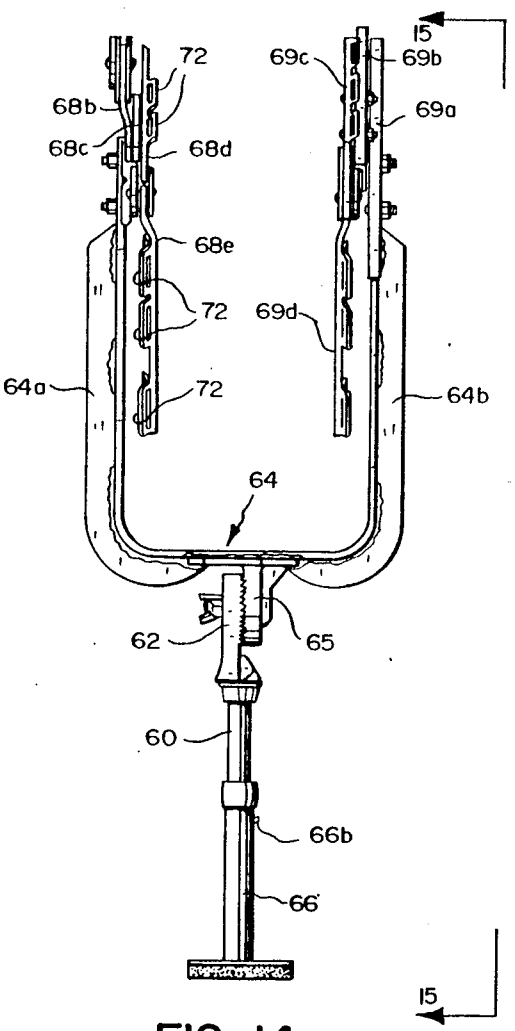

FIGS. 13–17 show an alternative embodiment of the walking device of the invention. As best shown in FIG. 14, upstanding staff 60 is provided with half of a radially splined joint, attachment means 62, for attaching yoke 64 which is provided with the other corresponding half of a radially splined joint, attachment means 65. Yoke 64 has right arm 64*a* and left arm 64*b*. Attachment means 62 and 65 enable attachment of the yoke to the staff so that the angle of attachment can be adjusted.

Figure 15:
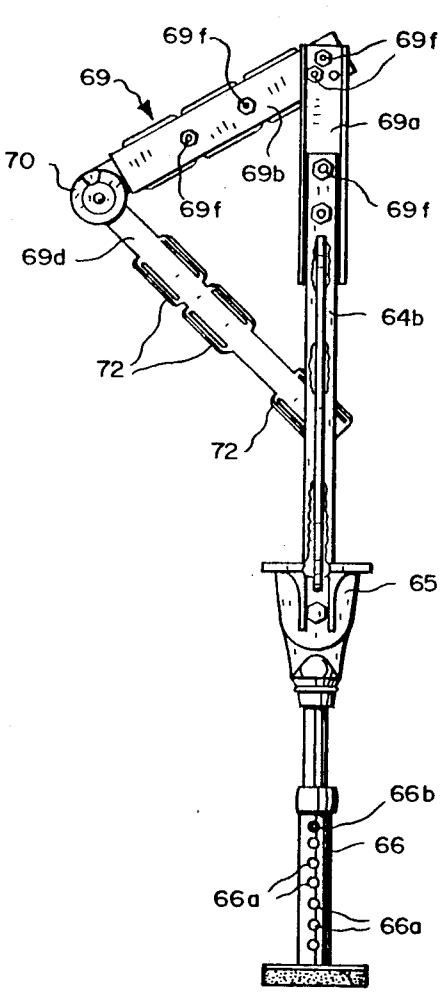

The lower portion of staff 60 has attached to it, square foot 66. As shown in FIG. 15, foot 66, has a plurality of holes 66*a* therethrough for receiving stop 66*b* so that the height of square foot 66 can be adjusted.

Figure 13:
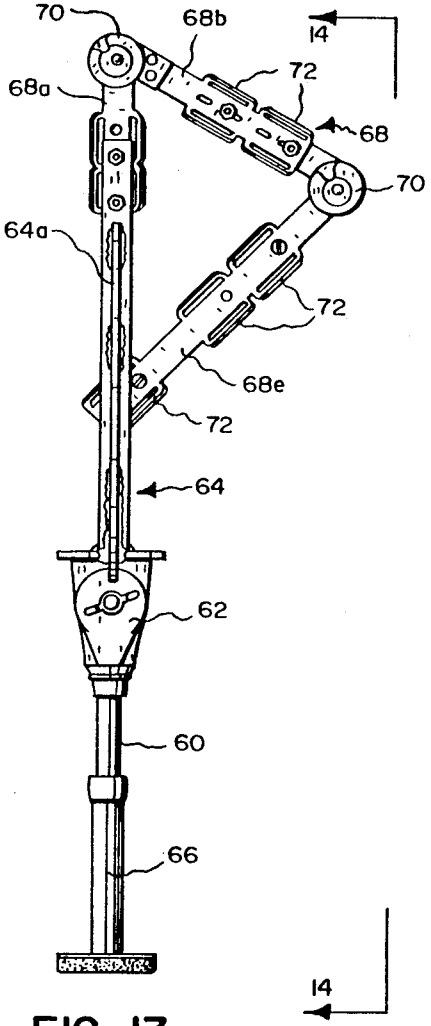

Returning to the yoke, each yoke arm has attached to its upper portion a support arm, 68 and 69, as shown in FIGS. 13 and 15. Support arms 68 and 69 can include four or five sections. As shown in FIG. 13 starting from the yoke, right support arm 68 includes, yoke section 68*a*. The lower portion of yoke section 68*a* of support arm 68 is attached to yoke arm 64*a*. The upper portion of yoke section 68*a* can be attached to lateral, upper section 68*b*, preferably by locking hinge means 70 so that the angle at which the two sections are held can be adjusted. As best shown in FIG. 14, intermediate, upper section 68*c* is sandwiched between lateral, upper section 68*b* and medial, upper section 68*d*. Medial, upper section 68*d* extends lower than either the lateral or intermediate, upper sections and is attached by locking hinge means 70 to lower section 68*e* of support arm 68.

Figure 17:
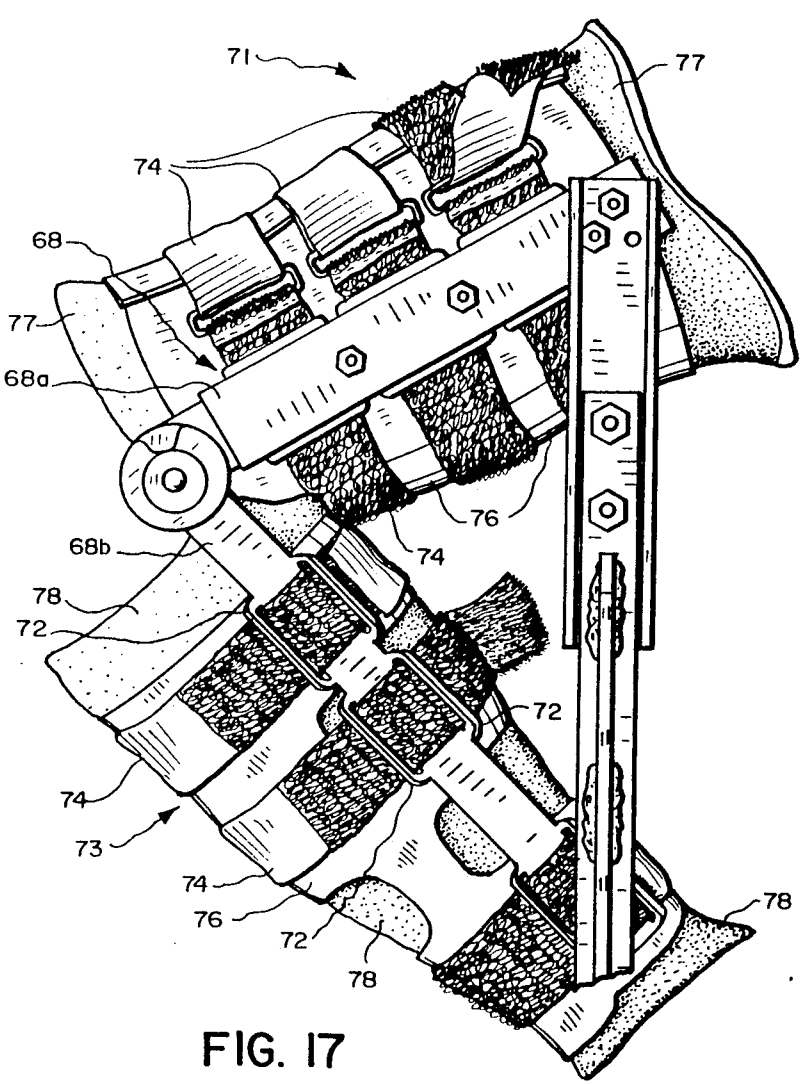
Figure 16:
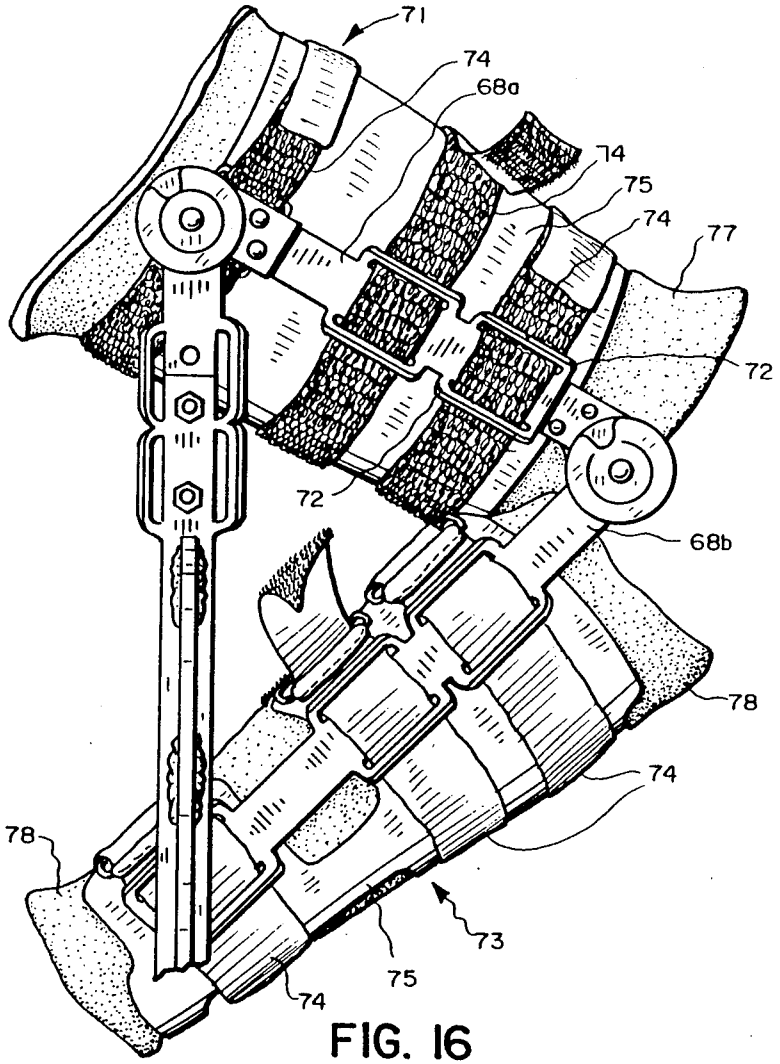

Medial, upper section 68*d* and lateral, upper section 68*b*, as well as lower section 68*e* and the corresponding sections of supporting arm 69 are provided with flanges 72 for receiving securing means, here shown as straps, 74, which secure padded receiving members 71 and 73 about the thigh and calf of the wearer, as shown in FIGS. 16 and 17. Straps 74 are shown passing through flanges 72 in FIGS. 16 and 17.

On the left side of the device, as shown in FIGS. 14 and 15, support arm 69 includes yoke section 69*a*, the lower portion of which is attached to yoke arm 64*b* by attachment means 69*f*. Along its upper portion, yoke section 69*a* is attached to lateral, upper section 69*b* by attachment means 69*f*. As shown in FIG. 14, lateral, upper section 69*b* lies essentially adjacent to medial, upper section 69*c*. The two sections are joined by attachment means 69*f*, as shown in FIG. 15. Medial, upper section 69*c* extends slightly lower than lateral, upper section 69*b* and is attached to lower section 69*d*, preferably by adjustable locking hinge means 70.

Padded receiving members 71 and 73 include support members 75 and 76 and padding 77 and 78. Support members 75 and 76 are attached to support arms 68 and 69 by attachment means (not shown). Padding 77 and 78 can be attached to support members 75 and 76. Padded receiving members 71 and 73 receive the thigh and calf of the user so that the injured limb bears the load essentially in compression, i.e., not in shear.

Whereas this invention is here illustrated and described with reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. A walking device to assist a lame or injured person in walking, comprising an upstanding staff, a substantially rigid upper receiving member articularly attached to said staff on an axis that is substantially perpendicular to said staff while the device is in an operable condition for receiving the thigh of an injured limb and a substantially rigid lower receiving member articularly attached to said staff on an axis substantially perpendicular to said staff for receiving the shin of an injured limb so that the injured limb bears the load essentially in compression and not in shear; said walking device rigidly extending the wearer's pelvis to a walking surface, thus, enabling the wearer to walk.

2. A walking device according to claim 1, including upper and lower extension arms attached to and extending substantially horizontally from upper and lower portions of said staff, respectively, said upper receiving member being attached to said upper extension arm and said lower receiving member being attached to said lower extension arm.

3. A walking device according to claim 1, additionally including securing means for securing said receiving members to the injured limb.

4. A walking device according to claim 2, including a cast and wherein said receiving members are mounted within said cast which is around the wearer's limb.

5. A walking device according to claim 2, wherein the upper extension arm is formed from the upper portion of said staff.

6. A walking device according to claim 2, wherein the receiving members are attached to said upper and lower extension arms, respectively, by clamping means.

7. A walking device according to claim 2, wherein the receiving members include: platforms for attaching to said extension arms and for attaching padded means, said platforms having clamping means for securing said platform means to said extension arms; and padded means for attaching to said platform portion and receiving the injured limb.

8. A walking device according to claim 2, wherein the upper and lower extension arms are provided as separate members for attaching to staff 10.

9. A walking device according to claim 8, wherein the upper end of the staff is adapted to receive the upper extension arm and is provided with a locking collar, said locking collar when unlocked allowing the height of said upper extension arm to be adjusted.

10. A walking device according to claim 8, wherein the extension arms each have a plurality of holes drilled therethrough and the staff has a plurality of holes drilled therethrough, said holes adapted to receive attachment means for securing said extension arms to said staff and adapted to attach said extension arms at varying heights along said staff.

11. A walking device according to claim 1, additionally comprising at least one securing means for each receiving member; and attachment means for attaching opposite portions of said securing means around the thigh and the calf of an injured limb and to each said receiving member.

12. A walking device according to claim 2, wherein at least one of the receiving members is provided with clamping means for attaching such receiving member to the extension arm.

13. A walking device according to claim 12, wherein the clamping means is provided with a threaded rod so that, when said rod is loosened, the angle relative to the horizontal plane of the extension arm at which the receiving member is held can be adjusted.

14. A walking device according to claim 1, wherein a recess and a foot piece are provided at the bottom of the staff, and the device additionally comprises:

a plunger and a coil spring, the coil spring being inserted in said recess at the bottom of the staff, said spring being arranged to interact with s id foot piece to absorb the shock of contact of the foot piece with a walking surface.

15. A walking device according to claim 1, additionally comprising a separate foot piece attached to the bottom of the staff.

16. A walking device according to claim 1, wherein the lower end of the upstanding staff is adapted to receive a separate foot member and said foot member is selected from the group consisting of a spring-loaded foot, a right angle foot, a rocker foot, a square foot, a bipod foot, a tripod foot, and a quadripod foot.

17. A walking device according to claim 1, wherein the lower end of the upstanding staff is formed into a foot.

18. A walking device according to claim 1, wherein the lower receiving member is attached to and suspended from the upper receiving member.

19. A walking device to assist a lame or injured person in walking, comprising an upstanding staff; a Y-shaped yoke member having a stem and right and left yoke arms, said yoke member having its stem attached tot he upper end of said staff; left and right receiving member support arms having upper and lower sections, said receiving member support arms attached, respectively, to the upper portions of said right and left yoke arms; upper and lower receiving members for receiving the thigh and leg, respectively, of an injured limb so that the injured limb bears the load essentially in compression and not in shear, said upper and lower receiving members being secured to the upper and lower sections, respectively, of said receiving member support arms; and securing means for securing said receiving members to the injured limb.

* * * * *